US008764575B1

(12) United States Patent
Gurley

(10) Patent No.: US 8,764,575 B1
(45) Date of Patent: Jul. 1, 2014

(54) TRAMPOLINE ARENA

(71) Applicant: Marcus E. Gurley, Lake Mary, FL (US)

(72) Inventor: Marcus E. Gurley, Lake Mary, FL (US)

( * ) Notice: Subject to any disclaimer, the term of this patent is extended or adjusted under 35 U.S.C. 154(b) by 0 days.

(21) Appl. No.: 14/182,775

(22) Filed: Feb. 18, 2014

Related U.S. Application Data

(63) Continuation of application No. 14/151,975, filed on Jan. 10, 2014, which is a continuation of application No. 13/164,356, filed on Jun. 20, 2011, now Pat. No. 8,657,696.

(60) Provisional application No. 61/356,108, filed on Jun. 18, 2010.

(51) Int. Cl.
*A63C 19/02* (2006.01)
*A63B 5/11* (2006.01)

(52) U.S. Cl.
CPC ..... *A63B 5/11* (2013.01)
USPC ..... 472/92; 482/27

(58) Field of Classification Search
USPC ..... 472/92–94; 482/23, 27, 29–31
See application file for complete search history.

(56) References Cited

U.S. PATENT DOCUMENTS

| | | | | |
|---|---|---|---|---|
| 3,339,925 | A * | 9/1967 | Nissen | 473/469 |
| 4,341,379 | A * | 7/1982 | Milligan | 482/28 |
| 5,624,122 | A * | 4/1997 | Winkelhorn | 473/471 |
| 6,053,845 | A * | 4/2000 | Publicover et al. | 482/35 |
| 6,261,207 | B1 * | 7/2001 | Publicover et al. | 482/27 |
| 6,607,468 | B1 * | 8/2003 | Nichols et al. | 482/27 |
| 8,672,813 | B2 | 3/2014 | West | |

* cited by examiner

*Primary Examiner* — Kien Nguyen
(74) *Attorney, Agent, or Firm* — Allen, Dyer, Doppelt, Milbrath & Gilchrist, P.A.

(57) ABSTRACT

A trampoline arena includes a framework assembly having a plurality of frame elements defining an outwardly sloping outer wall, and a deck, a plurality of voids being defined between the framework elements. The arena also includes a plurality of trampolines connected to the frame elements along peripheries thereof and extending across the plurality of voids to further define the outwardly sloping outer wall and deck, and a padding assembly including a plurality of pads overlying the frame elements and the peripheries of the trampolines.

19 Claims, 6 Drawing Sheets

TRAMPOLINE ARENA

CROSS-REFERENCE TO RELATED APPLICATIONS

This application is a continuation of U.S. Non-Provisional patent application Ser. No. 14/151,975 filed on Jan. 10, 2014, which is a continuation of U.S. Non-Provisional patent application Ser. No. 13/164,356, filed Jun. 20, 2011, which claims the benefit of U.S. Provisional Application Ser. No. 61/356,108, filed on Jun. 18, 2010, the contents of which applications are herein incorporated by reference in their entirety.

FIELD OF THE INVENTION

The present invention relates to trampolines, and more particularly, to arenas formed from a plurality of trampolines.

BACKGROUND OF THE INVENTION

Trampolines have long been recognized as a source of fun and exercise for young and old, alike. However, trampolines, and particularly large trampolines, have also been viewed as a considerable safety risk. As a result, trampolines have been underutilized in group and commercial recreation applications.

SUMMARY OF THE INVENTION

In view of the foregoing, it is an object of the present invention to provide an improved trampoline arena. According to an embodiment of the present invention, a trampoline arena includes a framework assembly having a plurality of frame elements defining an outwardly sloping outer wall, and a deck, a plurality of voids being defined between the framework elements. The arena also includes a plurality of trampolines connected to the frame elements along peripheries thereof and extending across the plurality of voids to further define the outwardly sloping outer wall and deck, and a padding assembly including a plurality of pads overlying the frame elements and the peripheries of the trampolines.

According to an aspect of the present invention, the plurality of frame elements further define a plurality of pyramids extending upwardly from the deck and plurality of pyramids, and the plurality of trampolines connected to the frame elements along the peripheries thereof and extending across the plurality of voids also further define the plurality of pyramids.

These and other objects, aspects and advantages of the present invention will be better appreciated in view of the drawings and following detailed description of preferred embodiments.

DETAILED DESCRIPTION OF PREFERRED EMBODIMENTS

Figure 1:
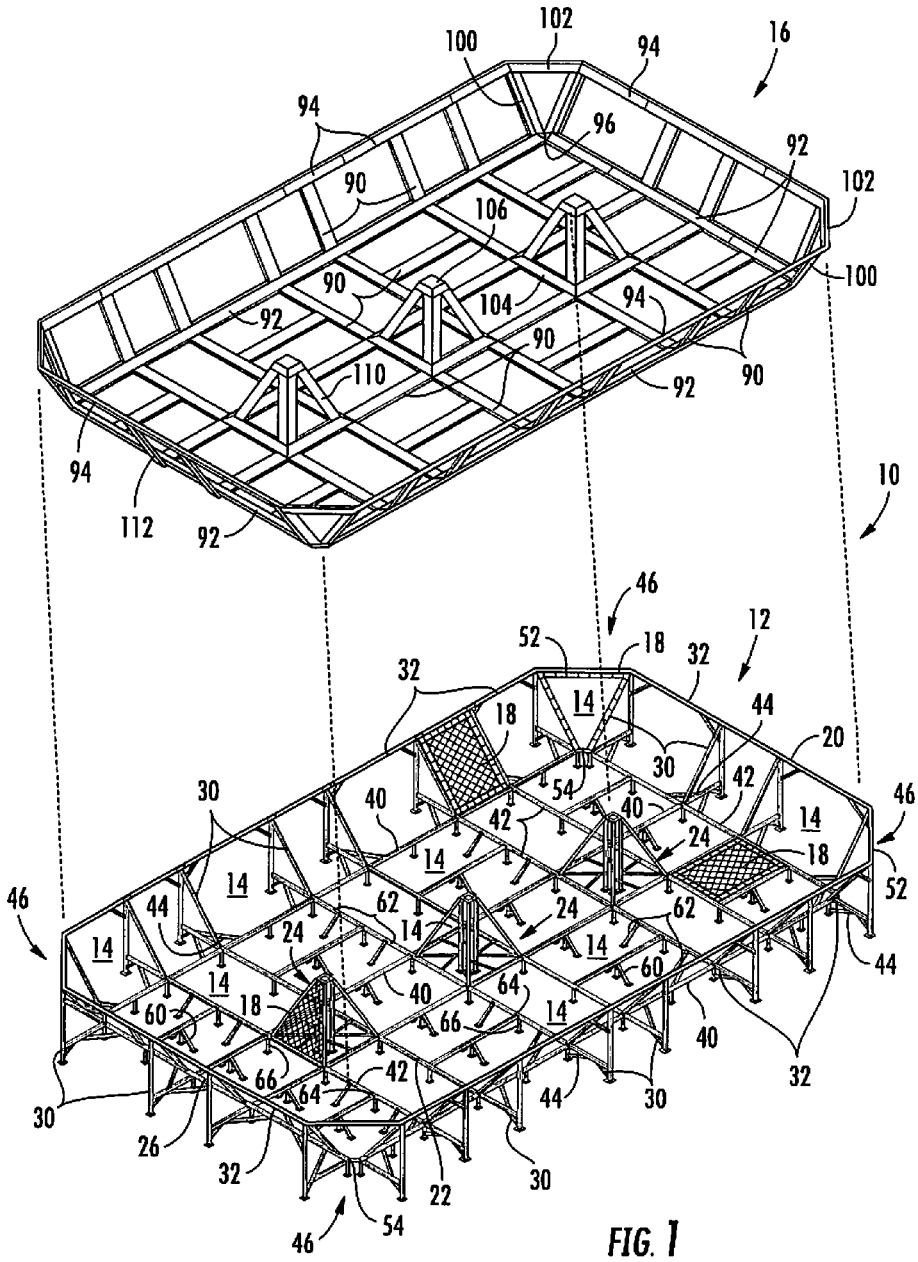
FIG. 1 is a partially exploded view of a trampoline arena, including a framework assembly, a padding assembly and a plurality of trampolines, according to an embodiment of the present invention.
Figure 1A:
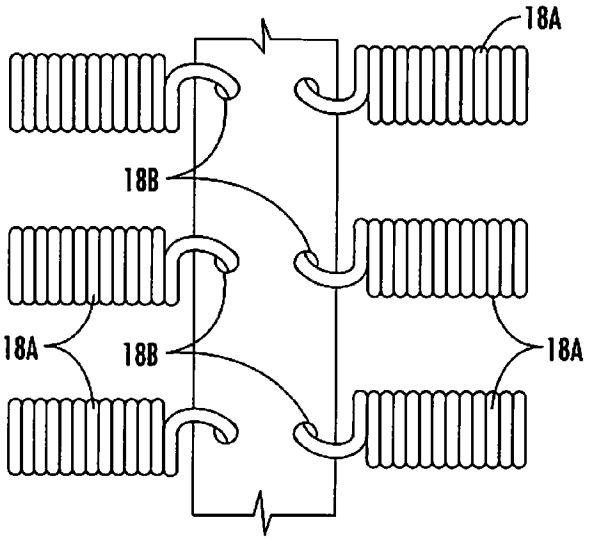
FIG. 1A is detail view of a representative connection between springs of the trampolines of FIG. 1 with elements of the framework assembly.

According to an embodiment of the present invention, referring to FIG. 1, a trampoline arena 10 includes a framework assembly 12 supporting a plurality of trampolines 18 (only a portion of the trampolines 18 are shown to more clearly depict the framework assembly 12) across voids 14 thereof, and a padding assembly 16 overlying the framework assembly 10 and peripheries of the trampolines 18. Referring to FIG. 1A, the trampolines 18 preferably connect to the framework assembly 12 via hooks at the end of trampoline springs 18A inserted into respective eyes 18B on members the framework. Connection points are advantageously close enough to eliminate the risk of appendages slipping between adjacent springs. The padding assembly 16 attaches to the framework assembly 12 via a plurality of hook and loop fasteners, or other fasteners.

Referring again to FIG. 1, the framework assembly 12 defines an outwardly sloping outer wall 20, a deck 22 and a plurality of pyramids 24 extending upwardly from the deck 22. An access opening 26 is formed through at least one side of the wall 20 by not placing a trampoline from the corresponding void 14. Advantageously, the framework assembly is adapted to bear the stresses of arena 10 usage while being completely free standing. However, if desired, the framework assembly 12 can be anchored at one or more points to structural members of a building in which the area 10 is located.

Figure 2:
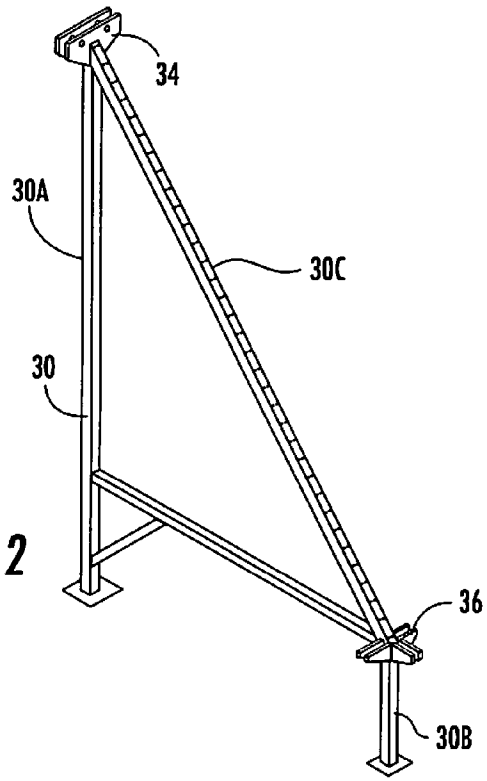
FIG. 2 is a perspective view of a side frame of the frame assembly of FIG. 1.

Referring also to FIG. 2, sides of the wall 20 are supported by a plurality of substantially parallel, spaced apart, side frames 30. Each side frame 30 includes first and second spaced apart side frame vertical members 30A, 30B and a side frame angled member 30C extending between the tops of the vertical members 30A, 30B. Upper frame members 32 connect to brackets 34 at the top of each side frame 30, tying the side frames 30 together and forming a top margin of the wall 20. Brackets 36 tie a knee of each side frame 30 into longitudinal and transverse frame elements 40, 42 of the deck 22. Bracing 44 extends between midpoints of the side frames and the frame elements 40, 42 to add further rigidity and strength.

Figure 4:
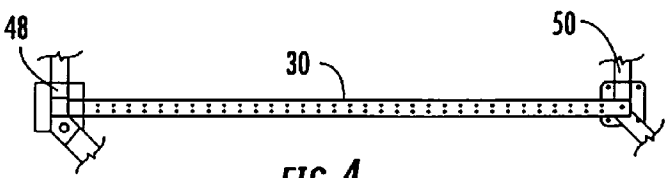
FIGS. 3 and 4 are top views of side frames of the frame assembly of FIG. 1, adjacent to opposite sides of a corner thereof.
Figure 3:
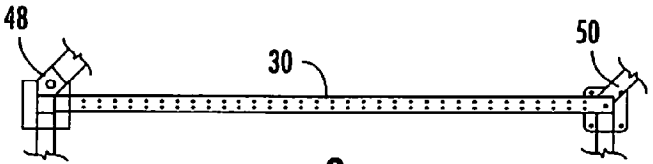

Referring to FIGS. 1, 3 and 4, at corners 46 of the wall 20, adjacent side frames 30 are arranged substantially perpendicular and upper and lower corner brackets 48, 50 are angled to tie into diagonal upper and lower corner members 52, 54. The design of corners 46 more evenly distributes stresses throughout the corner than a unitary member underlying the corner would, and increases available void space for trampolines at the corners 46.

Referring again to FIG. 1, the deck 22 is formed by the longitudinal and transverse frame elements 40, 42. Midpoints of the longitudinal frame elements 40 are supported by tripods 60 and midpoints of the transverse frame elements 42 are supported by angled legs 62. Deck brackets 64 and corresponding additional support legs 66 are located where longitudinal and transverse frame elements 40, 42 meet away from the outer wall 20 or pyramids 24.

Figure 5:
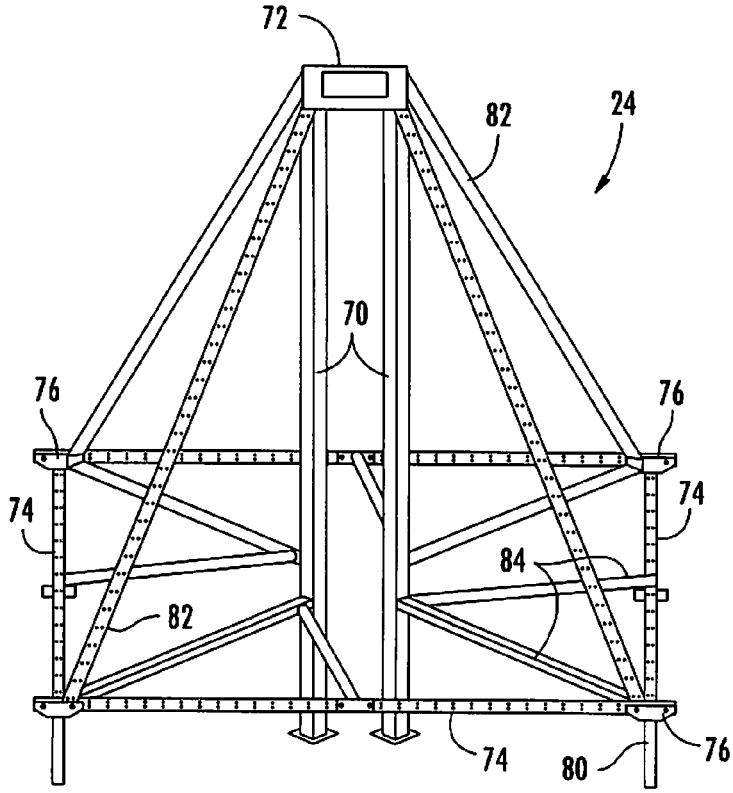
FIG. 5 is a perspective view of frame elements defining a pyramid of the arena of FIG. 1.

Referring also to FIG. 5, the pyramids 24 are interspersed throughout the deck 22, and offer additional visual interest and more gaming options to the arena 10. The pyramids 24 can also be arranged and used to help route existing building structures, such as pillars, through the arena 10, while protecting users therefrom. Alternately, the pyramids 24 could be omitted.

Each pyramid 24 includes four central vertical members 70 connected by a common top member 72, and four perimeter horizontal members 74 connected by a plurality of brackets 76 that also tie into the longitudinal and transverse frame elements 40, 42 of the deck 22. The perimeter horizontal members 74 are supported by perimeter legs 80 extending from the brackets 76. Additionally, a diagonal member 82 extends from each corner of the top member 72 to a corresponding one of the brackets 76. Dual bracing 84 connected to each vertical member 70 extends to respective corners and midpoints of the horizontal members 74.

Referring again to FIG. 1, the padding assembly 16 covers the framework assembly 12 cushioning any contact therewith, and inhibiting entanglement in trampoline springs. The padding assembly 16 is preferably formed from a plurality of foam pads sheathed in vinyl. The particular padding material can be chosen based on needs and preferences for a given application. However, a higher density foam, permitting a lower profile pad, is generally advantageous. Also, where pads abut a trampoline 14, the edges of the pad are preferably tapered or chamfered toward the trampoline 14. This arrangement reduces the likelihood of tripping over the edge of a pad while using the arena 10.

Figure 6:
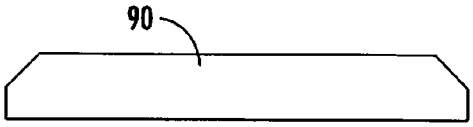
FIG. 6 is a side profile view of a flat pad of the pad assembly of FIG. 1.
Figure 7:
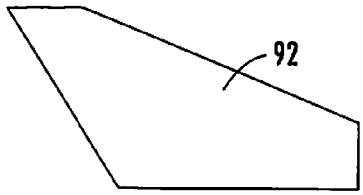
FIG. 7 is a side profile view of a side base pad of the pad assembly of FIG. 1.
Figure 8:
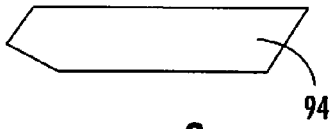
FIG. 8 is a side profile view of a side top pad of the pad assembly of FIG. 1.
Figure 9:
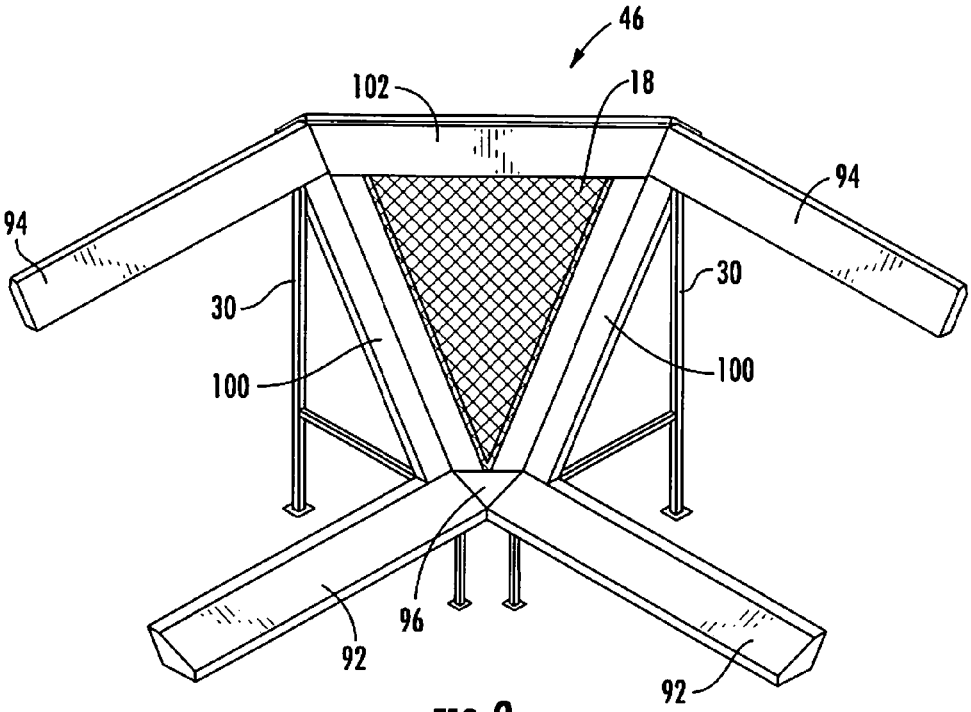
FIG. 9 is a perspective view of a corner of the arena of FIG. 1, including pad assembly components.
Figure 10:
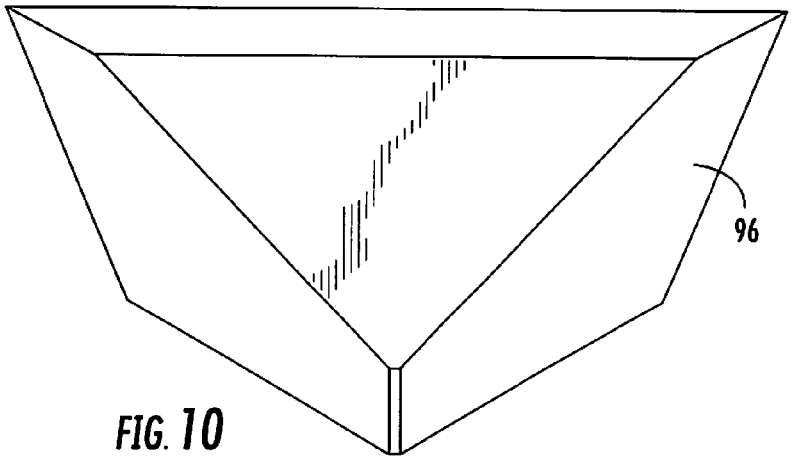
FIG. 10 is a perspective view of a triangular base pad of the pad assembly components of FIG. 9.
Figure 11:
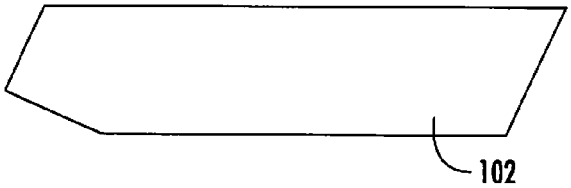
FIG. 11 is a side profile view of a corner top pad of the pad assembly components of FIG. 9.
Figure 12:
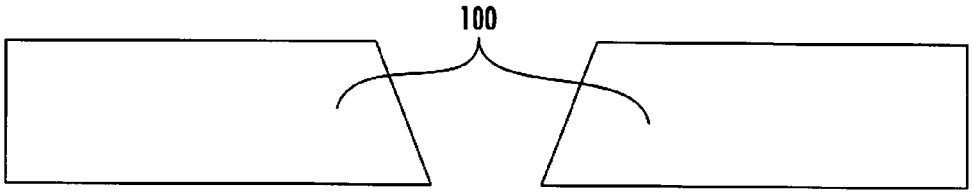
FIGS. 12 and 13 are side profile views of two-piece corner pads of the pad assembly components of FIG. 9.
Figure 13:
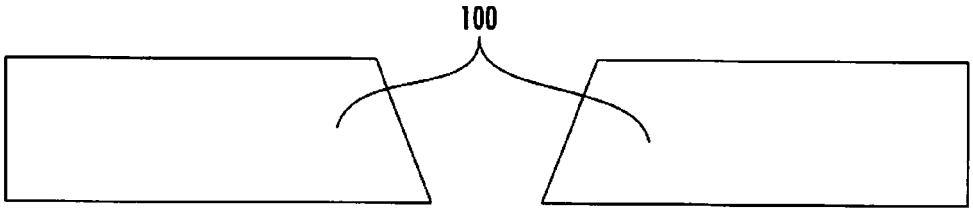
Figure 14:
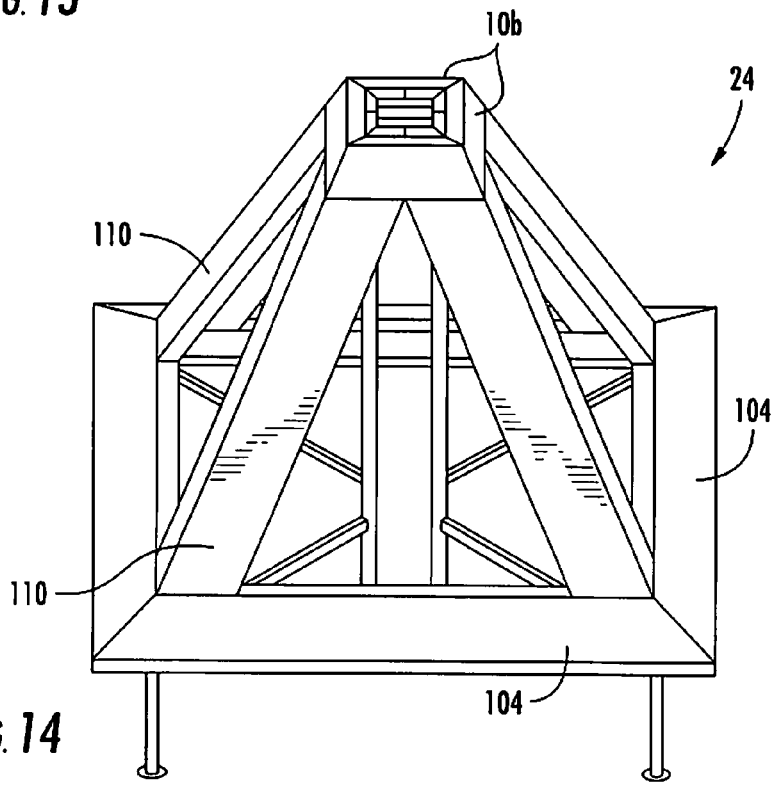
FIG. 14 is a perspective view of a pyramid of the arena of FIG. 1, including pad assembly components.
Figure 15:
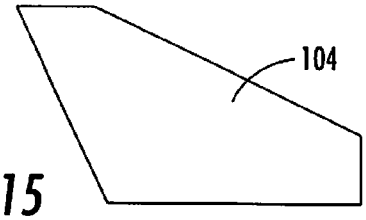
FIG. 15 is a side profile view of a pyramid base pad of the pad assembly components of FIG. 14.
Figure 16:
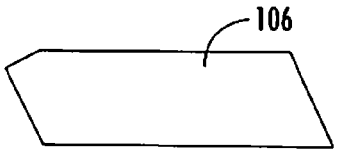
FIG. 16 is a side profile view of a pyramid top pad of the pad assembly components of FIG. 14.
Figure 17:
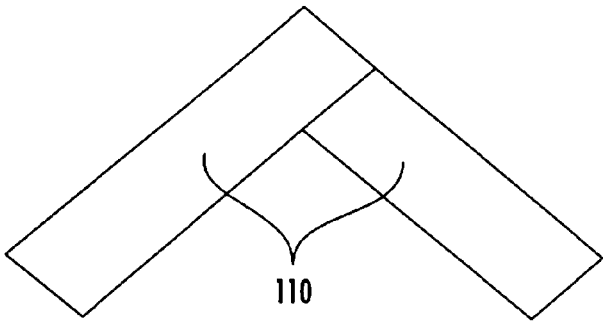
FIG. 17 is a side profile view of a two-piece pyramid side pad of the pad assembly components of FIG. 14.

Referring to FIG. 6, the side frames 40 forming sides of the wall 20 and most of the longitudinal and transverse members 40, 42 of the deck 22 are covered by generally flat pads 90. Referring to FIG. 7, longitudinal and transverse members 40, 42 forming an outside edge of the deck 22 are covered by side base pads 92 having a wedge-shaped profile with angularly offset flat edges to allow a smooth transition between the flat pads 90 on the deck 22 and the wall 20. Referring to FIG. 8, the upper frame members 32 are covered by side top pads 94.

Referring to FIGS. 9-13, at the corners 46, a triangular base pad 96 is arranged between opposite ends of adjacent base pads 92, covering the lower corner member 54. The side frames 40 in the corners 46 are covered by two-piece corner pads 100 extending upwardly from the junction of the base pads 92, 96. The upper corner member 52 is covered by a corner top pad 102, similar to the side top pads 94, but mitered at respective ends thereof to closely fit between the ends of adjacent side top pads 94.

Referring to FIGS. 14-17, the pyramids 24 have pyramid base pads 104 similar to the side base pads 92, but mitered to closely fit at respective ends thereof. Likewise, the pyramids have pyramid top pads 106 similar to the side top pads 94, but again mitered to fit closely at ends thereof. Two-piece pyramid side pads 110 extend between the base pads 104 and top pads 106 covering the diagonal members 82.

Figure 18:
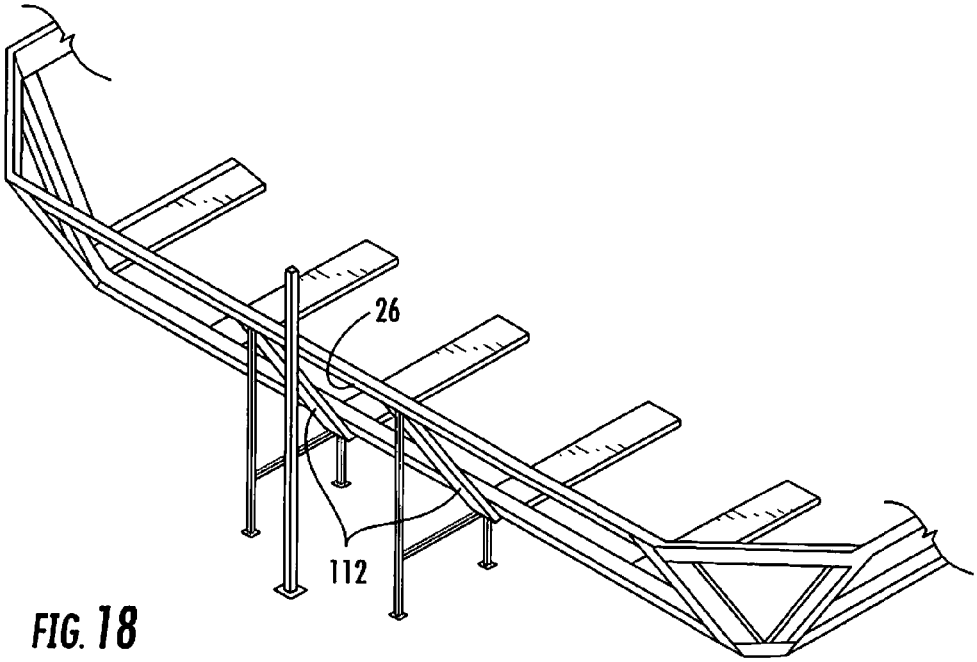
FIG. 18 is a perspective view of an access opening of the arena of FIG. 1, including pad assembly components.

Referring to FIG. 18, adjacent the opening 26, additional vertical padding 112 is included to offer extra protection for users entering and exiting the arena 10.

It will be appreciated from the foregoing, that aspects of the present invention provide an improved trampoline arena that can be freestanding, in which stresses from the use of the trampolines are very evenly distributed throughout the framework assembly, even in corners thereof. Moreover, the padding assembly closely conforms to the framework assembly, offering excellent protection while minimizing the likelihood of tripping.

The foregoing embodiment is provided for illustrative and exemplary purposes, the present invention is not necessarily limited thereto. Those skilled in the art will appreciate that various modifications, as well adaptations for particular circumstances, will fall within the scope of the invention as herein shown and described and of the claims appended hereto.

What is claimed is:

1. A trampoline arena comprising:

a plurality of side frames defining an outwardly sloping outer wall, each of the plurality of side frames including:

a rigid first upright member having a top first upright member portion and a bottom first upright member portion mountable to a floor; and a rigid angled member connected at an upper angled member portion to the top first upright member portion and extending at a downward angle therefrom to a lower angled member portion, a plurality of voids being defined between the plurality of angled members;

a horizontally-extending deck connected to the second angled member portions of the plurality of side frames;

a plurality of trampolines connected to the angled members along peripheries thereof and extending across the plurality of voids; and a padding assembly including a plurality of pads at least partially overlying the angled members and the peripheries of the trampolines.

2. The trampoline arena of claim 1, wherein each of the plurality of side frames further includes a rigid cross member extending between the first rigid upright member to the lower angled member portion.

3. The trampoline arena of claim 2, where each of the plurality of side frames further includes a rigid second upright member having a top second upright member portion connected to the lower angled member portion and a bottom second upright member portion mountable to a floor.

4. The trampoline arena of claim 3, wherein the rigid cross member includes a first cross member end connected between the top and bottom first upright member portions and a second cross member end connected at a junction of the lower angled member portion and the top second upright member portion.

5. The arena of claim 1, wherein the outer wall substantially surrounds the deck.

6. The arena of claim 1, wherein at least one of the plurality of voids is not covered such that an access opening for the trampoline arena is formed.

7. The arena of claim 1, further comprising:

at least one upper frame member interconnecting the plurality of side frames.

8. The arena of claim 7, wherein each of the plurality of side frames further includes an upper bracket connected to the top first upright member portion and receiving the at least one upper frame member.

9. The arena of claim 7, wherein the at least one upper frame member includes a plurality of upper frame members.

10. The arena of claim 1, wherein each of the plurality of side frames further includes a lower bracket connected to the lower angled member portion and attaching the deck thereto.

11. The arena of claim 10, wherein the deck comprises:

a plurality of intersecting longitudinal and transverse deck frame elements, a plurality of deck voids being defined between the plurality of intersecting longitudinal and transverse deck frame elements; and a plurality of deck trampolines connected to the plurality of intersecting longitudinal and transverse deck frame elements along peripheries thereof and extending across the plurality of deck voids.

12. The arena of claim 11, wherein the plurality of intersecting longitudinal and transverse deck frame elements are rigid elements.

13. The arena of claim 11, wherein the padding assembly at least partially overlays plurality of intersecting longitudinal and transverse deck frame elements and the peripheries of the deck trampolines.

14. The arena of claim 11, further comprising:

a plurality of support legs supporting the longitudinal and transverse deck frame elements.

15. The arena of claim 14, wherein the plurality of support legs are arranged at least one of: intersections of the longitudinal and transverse deck frame elements and midpoints between the intersections of the longitudinal and transverse deck frame elements.

16. The arena of claim 1, wherein the plurality of pads include a plurality of side base pads positioned along a transition between the outer wall and the deck, the side base pads having a wedge-shaped profile.

17. The arena of claim 16, wherein the plurality of pads include triangular base pads covering the lower corner members.

18. The arena of claim 1, wherein corners of the outer wall include a pair of generally perpendicular side frames connected by generally horizontal upper and lower corner members, such that trampoline covered voids are formed at the corners of the outer wall located at angles from adjacent sides of the outer wall.

19. A trampoline arena comprising:

a plurality of rigid side frames defining a wall, a plurality of voids being defined between the plurality of side frames, each of the plurality of rigid side frames comprising an upper bracket and a deck bracket, the plurality of side frames interconnected at the upper brackets by a plurality of upper frame members;

a plurality of trampolines connected to the side frames along peripheries thereof and extending across the plurality of voids;

a padding assembly including a plurality of pads at least partially overlying the side frames and the peripheries of the trampolines; and a trampoline covered deck connected to the plurality of side frames at the deck brackets.

* * * * *

UNITED STATES PATENT AND TRADEMARK OFFICE

CERTIFICATE OF CORRECTION

PATENT NO. : 8,764,575 B1
APPLICATION NO. : 14/182775
DATED : July 1, 2014
INVENTOR(S) : Marcus E. Gurley It is certified that error appears in the above-identified patent and that said Letters Patent is hereby corrected as shown below:

| | Claims |
|---|---|
| Column 4, Line 38, Claim 1 | Delete: "second" |
| | Insert: -- lower -- |

Signed and Sealed this
Twentieth Day of October, 2015

Michelle K. Lee

Michelle K. Lee
*Director of the United States Patent and Trademark Office*